US005904200A

United States Patent [19]

Agen

[11] Patent Number: 5,904,200

[45] Date of Patent: May 18, 1999

[54] SPINELESS SCREEN FRAME ASSEMBLY AND SCREEN FRAME MEMBER THEREFOR

[76] Inventor: James Edward Agen, 4603 Pine Harrier Dr., Sarasota, Fla. 34231

[21] Appl. No.: 09/059,021

[22] Filed: Apr. 13, 1998

[51] Int. Cl.[6] ..... A47H 13/00

[52] U.S. Cl. ..... 160/391; 160/371

[58] Field of Search ..... 160/371, 391, 160/327, 383, 395; 52/63, 222; 38/102.1, 102.91, 102.2

[56] References Cited

U.S. PATENT DOCUMENTS

| | | | |
|---|---|---|---|
| 1,624,534 | 4/1927 | Chewning | 160/391 X |
| 3,373,546 | 3/1968 | Setnan | 160/391 X |
| 4,233,790 | 11/1980 | Meadows | 160/395 X |
| 4,788,806 | 12/1988 | Sease | 160/395 X |
| 5,230,738 | 7/1993 | Wheeler | 160/327 X |

*Primary Examiner*—Blair M. Johnson
*Attorney, Agent, or Firm*—Charles J. Prescott

[57] ABSTRACT

An elongated frame member and a rectangular screen frame assembly including the frame member having a unique cross sectional shape of the frame member for the reception and retention of flexible fiberglass or other types of screening material without requiring a separate spline or locking strip component. The uniform frame member cross section includes a substantially box or rectangular shaped main portion and substantially U-shaped portion positioned adjacent said main portion, said U-shaped portion including spaced apart first and second side walls and a bottom wall therebetween. Each first side wall is preferably substantially common with or defined by one surface of said main portion. A first plurality of spaced apart resilient barbs each extend laterally in cantilevered fashion from the first side wall toward, but not to, the second side wall, while a second plurality of spaced apart resilient barbs each extend laterally in cantilevered fashion from the second side wall toward, but not to, the first side wall. The first and second plurality of barbs overlap each other in staggered fashion whereby a distal edge of each of the first and second plurality of barbs collectively define a serpentine or zigzag shaped screen retaining passage therebetween. These barbs are sufficiently resilient to be forcefully deflected to enlarge the width of, and somewhat straighten, the passage while the edge portion of the screen panel is inserted therein. The barbs resiliently return to a substantially at-rest position when released to lockingly engage and retain the screen edge portion in said passage while also tensioning the screen panel by drawing more of the margin into said passage.

3 Claims, 2 Drawing Sheets

SPINELESS SCREEN FRAME ASSEMBLY AND SCREEN FRAME MEMBER THEREFOR

BACKGROUND OF THE INVENTION

SCOPE OF INVENTION

This invention relates to screen frame means for fiberglass screen or other types of screening material in screen frame assemblies such as window screens, patio screen doors and the like, and more particularly to a frame member for such screen frame assemblies which eliminates the need for the retaining spline conventionally used to retain screen panels in place.

PRIOR ART

The use of screen material in window and patio door systems has been popular for many decades, providing air flow into a room while preventing entry of insects and wind born debris. Screen frames are component to windows and sliding glass doors systems and often made of rectangular rigid plastic extrusions similar to polystyrene and PVC. The frame has an elongated channel where the edges of screening or the like material are placed and a separate beading or spline is pushed to sandwich and secure the screening to the frame within the channel.

There are numerous disadvantages in the use of separate spline inserts which capture the screen material within the channel when the insert is pressed therein. Many frames vary in channel dimensions requiring the use of several dimensionally different spline inserts specifically designed for the increased or decreased channel size. The larger resulting inventories in the manufacture of plastic window and patio door screen involve extra costs and expenses associated with purchase and storage.

Another disadvantage of the use of a separate spline for securing the screen to the frame channel is that the resulting attachment is prone to pull free from the spline when a small force is applied against the screen creating a void or opening between the edge of the screen and frame.

Therefore, a primary object of the present invention is providing an improved method of installation and means for securing a fiberglass screen or other types of screening to a plastic or vinyl extruded frame.

A further object of the present invention is to provide an improved means for securing fiberglass screen or other types of screening to a plastic or vinyl extruded frame whereby separate spline or beading is not required.

A further object of the present invention is to provide an improved method of installation and means for securing fiberglass screen or other types of screening to a plastic or vinyl extruded frame whereby screening is easily installed and better secured to the frame.

A further object of the present invention is to provide an improved means for securing fiberglass screen or other types of screening to a plastic or vinyl extruded frame which is more economical to manufacture, durable in use and efficient in the purpose for which it is intended.

BRIEF SUMMARY OF THE INVENTION

This invention is directed to a rectangular screen frame assembly and an elongated frame member therefor, each frame member including a unique cross sectional shape for the reception and retention of an edge portion of flexible fiberglass or other types of screening material without requiring a separate spline or locking strip component. The cross section includes a substantially box or rectangular shaped main portion for strength and rigidity and a substantially U-shaped screen retaining channel positioned directly adjacent said main portion, the channel including spaced apart first and second side walls and a bottom wall therebetween. The first side wall is preferably substantially common with or defined by one surface of said main portion. A first plurality of spaced apart resilient barbs substantially coextensive with the frame member itself extend laterally in cantilevered fashion from the side wall toward, but not to, the second side wall, while a second plurality of spaced apart resilient barbs extend laterally in cantilevered fashion from the second side wall toward, but not to, the first side wall. The distal edges of the first and second plurality of barbs overlap one other in staggered fashion to collectively define a serpentine or zigzag shaped screen margin receiving passage therebetween. The first and second plurality of barbs are sufficiently resilient to be forcefully deflected or bent to enlarge the width of the passage while a margin or edge portion of a screen panel is inserted therein. When the barbs are released to resiliently return to a substantially at-rest position, they lockingly cooperate to engage and retain the screen edge portion in the passage while also additionally tensioning the screen panel by drawing more of the screen edge portion into said passage.

It is therefore another primary object of the present invention to provide an improved screen and frame assembly wherein a separate spline or beading is not required to attach the edge portion of the screen within a screen retaining channel, the screen retaining channel including a series of opposing flexible elongated overlapping barbs extending inwardly and downward in spaced apart overlapping fashion toward the central portion of the channel.

The integrally formed first and second sets of flexible barbs of a staggered and overlapping configuration provide for retention of the edge portion of screen material directly in the screen retaining channel without the use of a separate spline thereby eliminating an inventory of separate spline or locking strip components. In the present invention, a self-locking spring or biasing force is produced when the barbs are resiliently deformed or deflected away from an at-rest position. While so held in this deformed position, the edge portion of the screen may be inserted into the widened passage, after which the barbs are released. The biased holding force produced along the distal edges of the lateral barb surfaces lock the screen in the screen retaining channel in the serpentine-shaped passage defined between the overlapping distal edges of the barbs when at rest in their original position.

The screen is preferably attached within the screen retaining channel by placing the edge portion of the screen over the screen retaining channel opening which is coextensive with the frame member. The screen is preferably pushed into the screen retaining channel using a narrow wheel roller tool or thin bladed tool which simultaneously forces the screen into the serpentine passage between the barbs as they are resiliently deflected by the tool. This causes the screen as it is pressed into the passage to extend fully into the serpentine passage around each of the distal edges of the flexible barbs. The screen is retained in the passage as the barbs resiliently return to an at-rest position when the tool is withdrawn or rolled along.

Securing screen material to the frame member in the above described manner results in a stronger attachment of the screen to each frame member so that the screen resists greater pulling force than with previous arrangements that use separate spline attachment arrangements.

In accordance with these and other objects which will become apparent hereinafter, the instant invention will now be described with reference to the accompanying drawings.

DESCRIPTION OF THE PREFERRED EMBODIMENT

Figure 1:
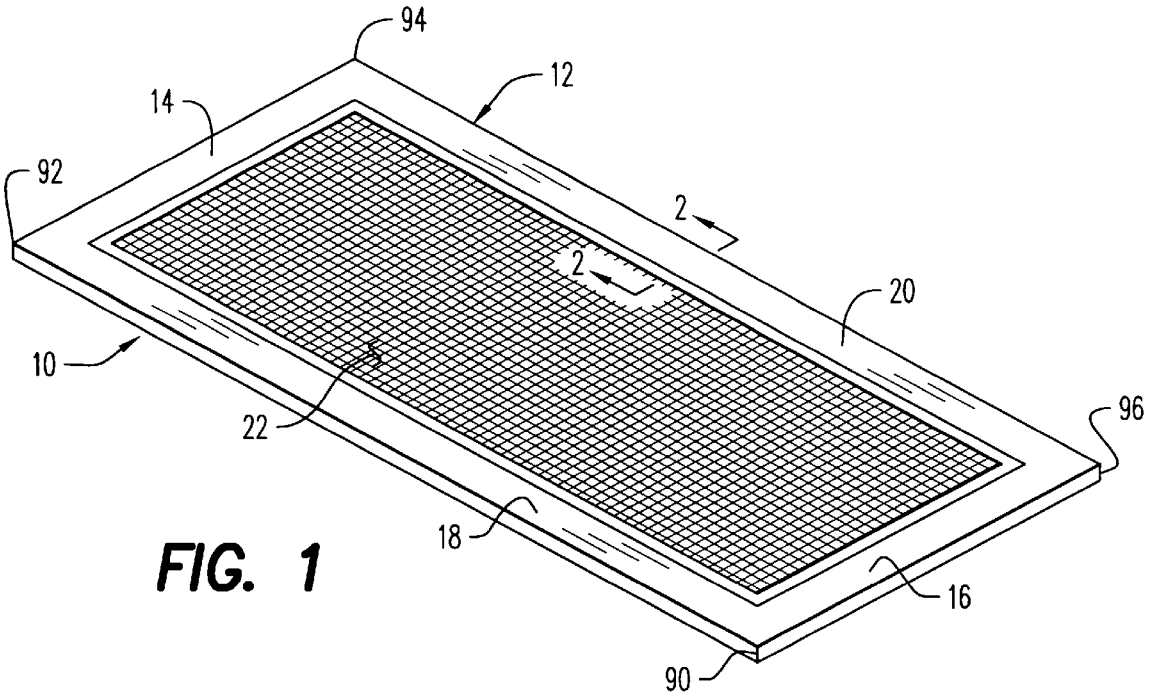
FIG. 1 is a perspective view of a window screen assembly (10) which embodies the present invention for attaching the flexible screen (22) to each frame member (14,16,18,20) of the screen frame assembly (12).

Referring to the drawings, the numeral 10 refers to a typical window screen assembly having a rectangular screen frame assembly 12 with flexible screening material 22 fitted and tensioned over the open area of the frame assembly 12. The frame assembly 12 includes a top frame member 14, a bottom frame member 16, and two opposite frame members 18, 20 as viewed in FIG. 1. The screen 22 is stretched and secured along its edge portions to the frame members 14, 16, 18, and 20. The corners of the frame members 14, 16, 18 and 20 meet in miter joints designated by the numerals 90, 92, 94, and 96, forming the completed frame assembly including frame members 14, 16, 18, and 20.

Figure 4:
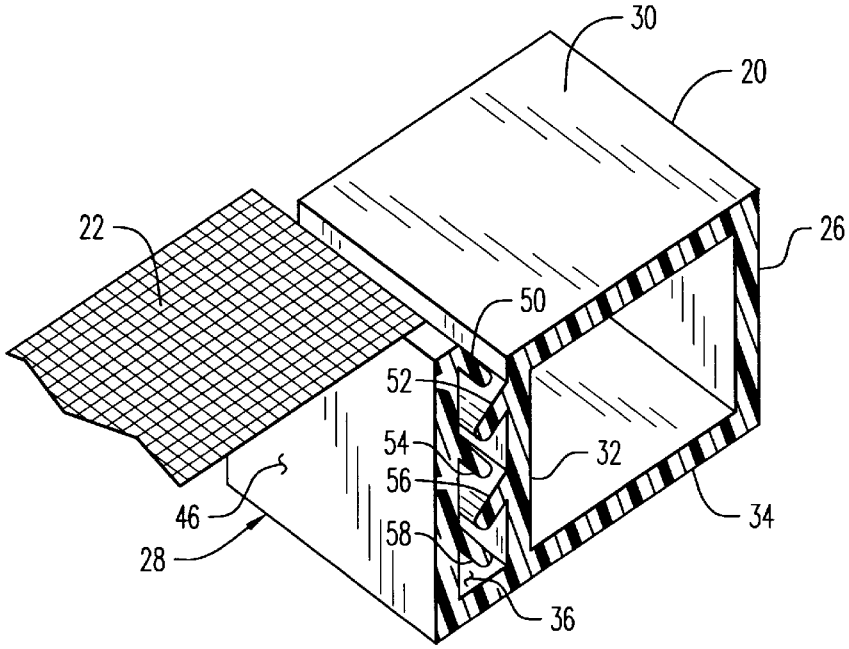
FIG. 4 is a detailed perspective view of FIG. 2.
Figure 3:
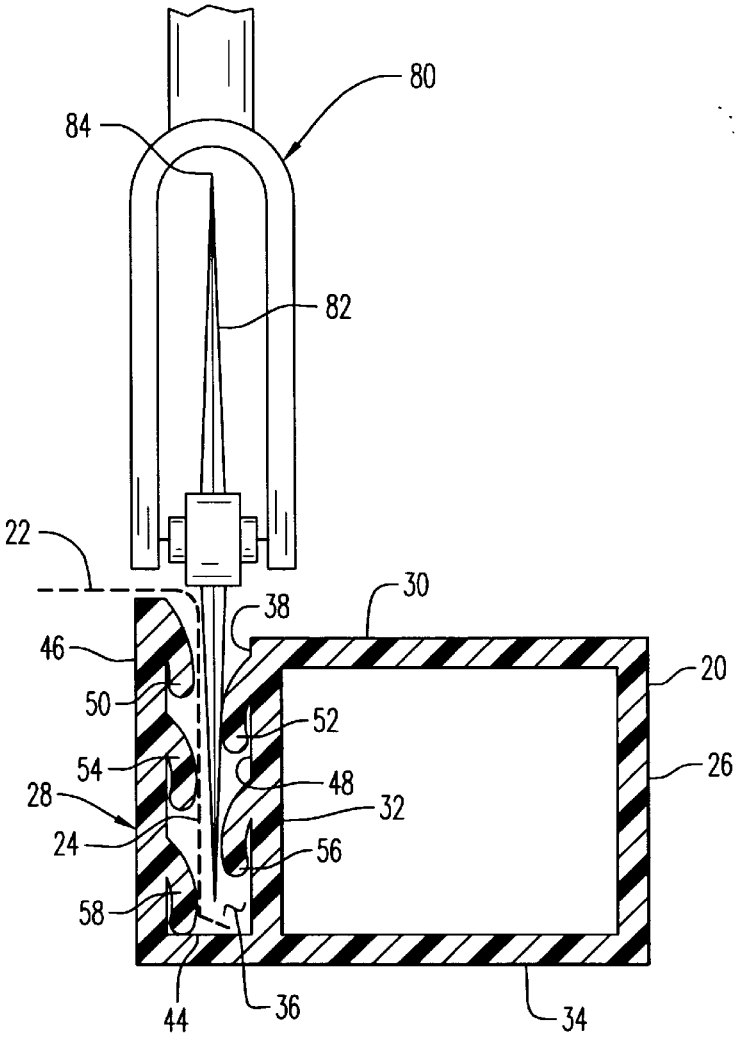
FIG. 3 is a view similar to FIG. 2 showing an installation tool (80) and the preferred method by which the screen (22) is installed into the screen retaining channel (36) of the frame member (20).
Figure 2:
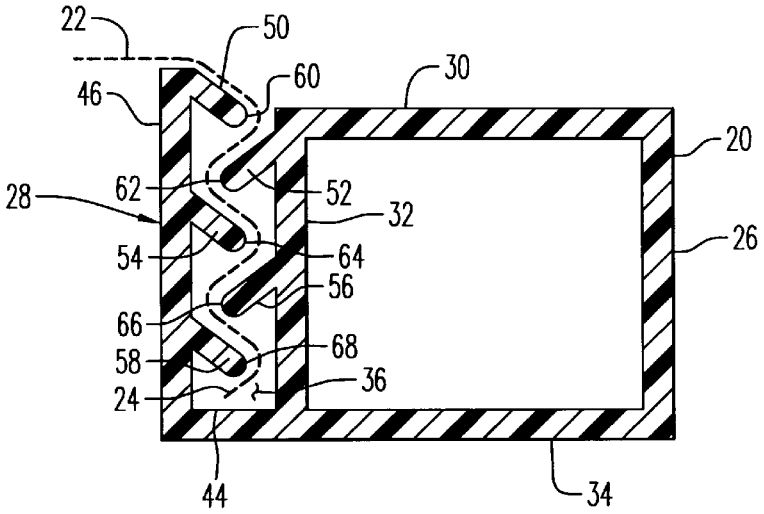
FIG. 2 is a sectional view taken along line 2—2 of FIG. 1

Frame members 14, 16, 18, and 20 are all of the same structure in cross section and, therefore, the cross sectional structure of frame member 20 shown in FIGS. 2, 3 and 4 is exemplary of the other frame members 14, 16, and 18. The detailed description of the frame member 20 herebelow therefore applies generally to all frame members of the frame assembly.

Frame member 20 includes in cross section a box shaped main portion 26 and a U-shaped portion 28 positioned adjacent and extending laterally therefrom. As oriented in the Figures, main portion 26 is primarily for frame support and rigidity and to provide desired edge configurations such as for mating against a doorjamb or a window frame guide and includes a top horizontal portion 30, a bottom horizontal portion 34 and a side vertical portion 32. Although the simple box section is preferred, other cross sectional shapes for the main portion are envisioned. The U-shaped portion 28 is primarily intended to retain the screen panel 22 in place and includes a screen retaining channel 36 defined by a horizontal bottom wall 44 and spaced apart side walls 46 and 48. A first plurality of spaced parallel barbs 50 extend inwardly and downwardly from side wall 46 while a second plurality of spaced parallel barbs 52 and 56 extend inwardly and downwardly from side wall 48.

The installation of the screen 22 into the screen retaining channel 36 is shown in FIG. 3. The edge portion 24 of screen 22 is first placed flat over the opening 38 of the screen retaining channel 36 so as to extend along the top portion 30 covering opening 38. The screen 22 is also stretched and flattened by hand to cover the entire open area of the screen frame 12. Thereafter, the edge portion 24 is forced downward through the serpentine passage defined between the first and second sets of barbs which must be resiliently deflected to effect this installation. The edge portion 24, once fully inserted, is deformed into the serpentine shaped passage defined by the barb distal edges 60, 62, 64, 66, 68 as shown in FIG. 2 when the barbs are released. It should be noted that the clearance between the respective barb distal edges 60, 62, 64, 66, 68 is such that a tight fit exists against the edge portion 24 to prevent slippage.

Insertion of the edge portion 24 into the U-shaped portion 28 is preferably accomplished as shown in FIG. 3. An installation tool 80 is used for this purpose and includes a rotatable wheel 82 having an outer circumferential edge 84. The wheel 82 is forced downwardly and held thusly to resiliently deflect all of the barbs and to increase and somewhat straighten the serpentine passage as the wheel is rolled along the length of the frame members 20.

Barbs 50, 52, 54, 56, and 58 as well as the entire frame member 20 formed as a single unit, are preferably comprised of PVC or other suitable resilient plastic material which is substantially rigid, but which is also capable of being resiliently deformed in response to pressure in the manner shown in FIG. 3. The pressure of the wheel 82 causes the barbs 50, 52, 54, 56, and 58 to deform as the edge portion 24 is simultaneously pushed downwardly within the channel 36. The barbs have sufficient resiliency, due in part to the thinner cantilevered design, to resume their original shape within the channel 36 as the wheel 82 rollingly progresses along the length of the channel 36. The edge portion 24 is held secure within the channel 36 by virtue of the cooperative resilient interaction of barb edges 60, 62, 64, 66 and 68 as they are released to return to their at-rest position.

With the edge portion 24 installed into the position in the channel 36 shown in FIG. 3, the barbs resiliently return to their at-rest position in FIGS. 2 and 4 as the wheel 82 is moved along the length of the channel 36. In so returning to the at-rest position, the barbs cooperate to draw even more of the screen 22 into the channel 36, automatically producing additional screen tensioning by drawing more of the edge portion 24 into the at-rest serpentine passage shape of FIG. 2. The force required to pull the screen 22 out of attachment within the channel as described above is substantially greater than the force required with prior methods for securing screen to channels.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

I claim:

1. A frame member for a rectangular screen frame assembly comprising:

a substantially straight single elongated unit having a substantially uniform cross section over an entire length thereof, said cross section including a substantially rectangular box shaped main portion and substantially U-shaped portion positioned adjacent said main portion, said U-shaped portion including spaced apart first and second side walls and a bottom wall therebetween;

said first side wall being substantially defined by one surface of said main portion;

a first plurality of spaced apart resilient barbs each extending laterally in cantilevered fashion from said first side wall toward, but not to, said second side wall;

a second plurality of spaced apart resilient barbs each extending laterally in cantilevered fashion from said second side wall toward, but not to, said first side wall;

said first and second plurality of barbs overlapping each other in staggered fashion, a distal edge of each of said first and second plurality of barbs collectively defining a serpentine or zigzag shaped screen retaining passage therebetween, said first and second plurality of barbs being sufficiently resilient to be forcefully deflected to enlarge a width of, and somewhat straighten, said passage while an edge portion of a screen panel of said screen frame assembly is inserted therein, said barbs resiliently returning to a substantially at-rest position, when released, to lockingly engage and retain the screen edge portion in said passage.

2. A rectangular screen frame assembly comprising:

a plurality of frame members connected together orthogonally at corresponding ends thereof to define an open central area covered by a panel of flexible screen;

each frame member of said plurality of frame members formed as a substantially straight single elongated unit having a substantially uniform cross section over an entire length of said frame member, said cross section including a substantially rectangular box shaped main portion and a substantially U-shaped portion defining a screen receiving channel positioned adjacent said main portion, said U-shaped portion including spaced apart first and second side walls and a bottom wall therebetween;

said first side wall of each said frame member being substantially defined by one surface of said main portion;

each said frame member including a first plurality of spaced apart resilient barbs each extending laterally in cantilevered fashion from said first side wall toward, but not to, said second side wall;

each said frame member also including a second plurality of spaced apart resilient barbs each extending laterally in cantilevered fashion from said second side wall toward, but not to, said first side wall;

said first and second plurality of barbs overlapping each other in staggered fashion, a distal edge of each of said first and second plurality of barbs collectively defining a serpentine or zigzag shaped screen retaining passage therebetween, said first and second plurality of barbs being sufficiently resilient to be forcefully deflected to enlarge a width of, and somewhat straighten, said passage while one edge portion of said screen panel is inserted therein, said barbs resiliently returning to a substantially at-rest position, when released, to lockingly engage and retain said screen edge portion in said passage while also further tensioning the screen panel by drawing more of said edge portion into said passage.

3. A frame member for a rectangular screen frame assembly comprising:

a substantially straight single elongated unit having a substantially uniform cross section over an entire length thereof, said cross section including a main portion and substantially U-shaped portion positioned adjacent said main portion, said U-shaped portion including spaced apart first and second side walls and a bottom wall therebetween;

said first side wall being substantially defined by one surface of said main portion;

a first plurality of spaced apart resilient barbs each extending laterally in cantilevered fashion from said first side wall toward, but not to, said second side wall;

a second plurality of spaced apart resilient barbs each extending laterally in cantilevered fashion from said second side wall toward, but not to, said first side wall;

said first and second plurality of barbs overlapping each other in staggered fashion, a distal edge of each of said first and second plurality of barbs collectively defining a serpentine or zigzag shaped screen retaining passage therebetween, said first and second plurality of barbs being sufficiently resilient to be forcefully deflected to enlarge a width of, and somewhat straighten, said passage while an edge portion of a screen panel of said screen frame assembly is inserted therein, said barbs resiliently returning to a substantially at-rest position, when released, to lockingly engage and provide an only means for retaining the screen edge portion in said passage.

* * * * *